US007421892B2

(12) United States Patent
DiFoggio et al.

(10) Patent No.: US 7,421,892 B2
(45) Date of Patent: Sep. 9, 2008

(54) METHOD AND APPARATUS FOR ESTIMATING A PROPERTY OF A DOWNHOLE FLUID USING A COATED RESONATOR

(75) Inventors: Rocco DiFoggio, Houston, TX (US); Peter W. Reittinger, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/588,827

(22) Filed: Oct. 27, 2006

(65) Prior Publication Data

US 2007/0113639 A1 May 24, 2007

Related U.S. Application Data

(63) Continuation-in-part of application No. 11/092,016, filed on Mar. 29, 2005, now Pat. No. 7,162,918.

(51) Int. Cl.
*E21B 44/00* (2006.01)

(52) U.S. Cl. ..... 73/152.47

(58) Field of Classification Search ..... 73/152.58, 73/152.47

See application file for complete search history.

(56) References Cited

U.S. PATENT DOCUMENTS 3,561,832 A 2/1971 Karrer et al.
5,302,879 A 4/1994 Totty et al.
5,741,962 A 4/1998 Birchak et al.
5,837,893 A 11/1998 Chu
6,938,470 B2 * 9/2005 DiFoggio et al. ..... 73/152.24
7,207,211 B2 * 4/2007 Carlson et al. ..... 73/54.41
2005/0262944 A1 * 12/2005 Bennett et al. ..... 73/592
2007/0095535 A1 * 5/2007 DiFoggio et al. ..... 166/302
2007/0175632 A1 * 8/2007 Powell et al. ..... 166/250.01

OTHER PUBLICATIONS http://www.azom.com/details.asp?ArticleID=2568, Non-Polymeric Medical Coatings.

Tiainen, Veli-Matti, Amorphous Carbon as a Bio-mechnaical Coating Mechanical properties and Biological Applications.

Shtansky, Petrzhik, Bashkova, Kiryukhantsev-Korneeve, Sheveiko & Levashov, Adhesion, Friction, and Deformation Characteristics of Ti-(Ca,Zr)-(C,N,O,P) Coatings for Orthopedic and Dental Implants, Journal Physics of the Solid State, Issue Vol. 48, No. 7, Jul. 2006.

* cited by examiner

*Primary Examiner*—Hezron E. Williams
*Assistant Examiner*—Rodney T Frank
(74) *Attorney, Agent, or Firm*—G. Michael Roebuck

(57) ABSTRACT

A method and apparatus for estimating a property of a fluid downhole are disclosed. The apparatus includes a coated flexural resonator disposed in the downhole fluid. The resonator is coated to reduce effects of adhering surfactants suspended in the downhole fluid. The method uses the coated resonator to estimate a property of the downhole fluid.

20 Claims, 5 Drawing Sheets

METHOD AND APPARATUS FOR ESTIMATING A PROPERTY OF A DOWNHOLE FLUID USING A COATED RESONATOR

CROSS REFERENCE TO RELATED APPLICATIONS

This patent application is a Continuation in Part of U.S. patent application Ser. No. 11/092,016 filed on Mar. 29, 2005, now U.S. Pat. No. 7,162,918 which claims priority to U.S. patent application Ser. No. 10/144,965 filed on May 14, 2002 which issued as U.S. Pat. No. 6,938,470 B2 and which claims priority from U.S. Provisional Patent Application Ser. No. 60/291,136 filed on May 15, 2001, all of which are hereby incorporated by reference in their entirety.

BACKGROUND

1. Field of the Invention

The present invention relates to the field of downhole fluid analysis in hydrocarbon producing wells. More particularly, the present invention relates to a method and apparatus for determining downhole fluid density, viscosity, and other parameters.

2. Related Art

There is considerable interest in obtaining density and viscosity for formation fluids downhole at reservoir conditions of extreme temperature and pressure during formation sampling, production or drilling. Numerous technologies have been employed toward the end of measuring density and viscosity of liquids downhole.

SUMMARY OF THE DISCLOSURE

In a particular illustrative embodiment an apparatus for estimating a property of a downhole fluid is disclosed. The apparatus includes a coated flexural resonator disposed in the downhole fluid. The resonator is coated to reduce effects of adhering surfactants suspended in the downhole fluid. A particular illustrative embodiment includes a controller that actuates the flexural resonator at a frequency; a monitor that measures electrical impedance versus the frequency of the flexural resonator; and a processor that estimates the property of the downhole fluid from the measured electrical impedance. In another aspect of a particular illustrative embodiment the flexural resonator is a piezoelectric resonator. It is desired that resonator be coated with a "non-stick" coating that is sufficiently hard so as not to be abraded away by passing sand particles in the formation fluid.

For such a coating, a droplet of reservoir fluid would bead up on its surface because the surface tension of the fluid would exceed the critical surface tension of the coating. A coating is hydrophobic when water beads up on its surface, and lipophobic when oil beads up on its surface. An illustrative embodiment of a "non-stick" coating is both hydrophobic and lipophobic and has a low critical surface tension comparable to that of the fluoropolymer, Teflon™ (18 dynes/cm=18 milli-Newtons/meter) in addition to having the abrasion resistance of a hard ceramic or metal instead of the abrasion resistance of a soft polymer.

In an illustrative embodiment, the coating should also be chemically resistant, thermally stable, and highly conformal to insure that no exposed parts of the resonator remain uncoated. The coating should also be capable of being applied as a very thin layer (microns or less) to minimize the influence of the coating on the resonator as well as to minimize any changes in the coating's influence as the ambient pressure and temperature increases downhole. In another aspect of a particular embodiment the flexural resonator is coated with a lipophobic coating. In another aspect of a particular embodiment the resonator is coated with a hydrophobic coating. In another aspect of a particular embodiment the resonator is coated with AMC 228-18. In another aspect of a particular embodiment the resonator is coated with a material selected from the group consisting of a diamond-like carbon (DLC) coating and combinations of Ti, Co and Zr with one of N, C, O and P.

In another particular illustrative embodiment a method for estimating a property of a downhole fluid is disclosed. The method including coating a flexural piezoelectric resonator to reduce effects of adhering surfactants suspended in the downhole fluid; disposing the flexural piezoelectric resonator in the downhole fluid; directly moving the fluid by actuating the flexural piezoelectric resonator; measuring an electrical impedance versus frequency of the flexural piezoelectric resonator; and estimating the property of the downhole fluid from the measured electrical impedance. In another aspect of a particular embodiment the coating is a lipophobic coating. In another aspect of a particular embodiment the coating is a hydrophobic coating. In another aspect of a particular embodiment the coating is AMC 228-19.

In another particular embodiment a downhole tool for estimating a property of a downhole fluid is disclosed. The downhole tool includes a flexural piezoelectric resonator associated with the downhole tool and disposed in the downhole fluid. The resonator is coated to reduce effects of surfactants suspended in the downhole fluid temporarily adhering to the surface of the resonator. The downhole tool further includes a controller that actuates the flexural piezoelectric resonator at a frequency; a monitor that measures electrical impedance versus the frequency of the flexural piezoelectric resonator; and a processor that estimates the property of the downhole fluid from the measured electrical impedance. In another aspect of a particular embodiment the resonator is coated with a lipophobic coating. In another aspect of a particular embodiment the resonator is coated with a hydrophobic coating. In another aspect of a particular embodiment the resonator is coated with AMC 228-18.

DETAILED DESCRIPTION OF ILLUSTRATIVE EMBODIMENTS

Figure 1:
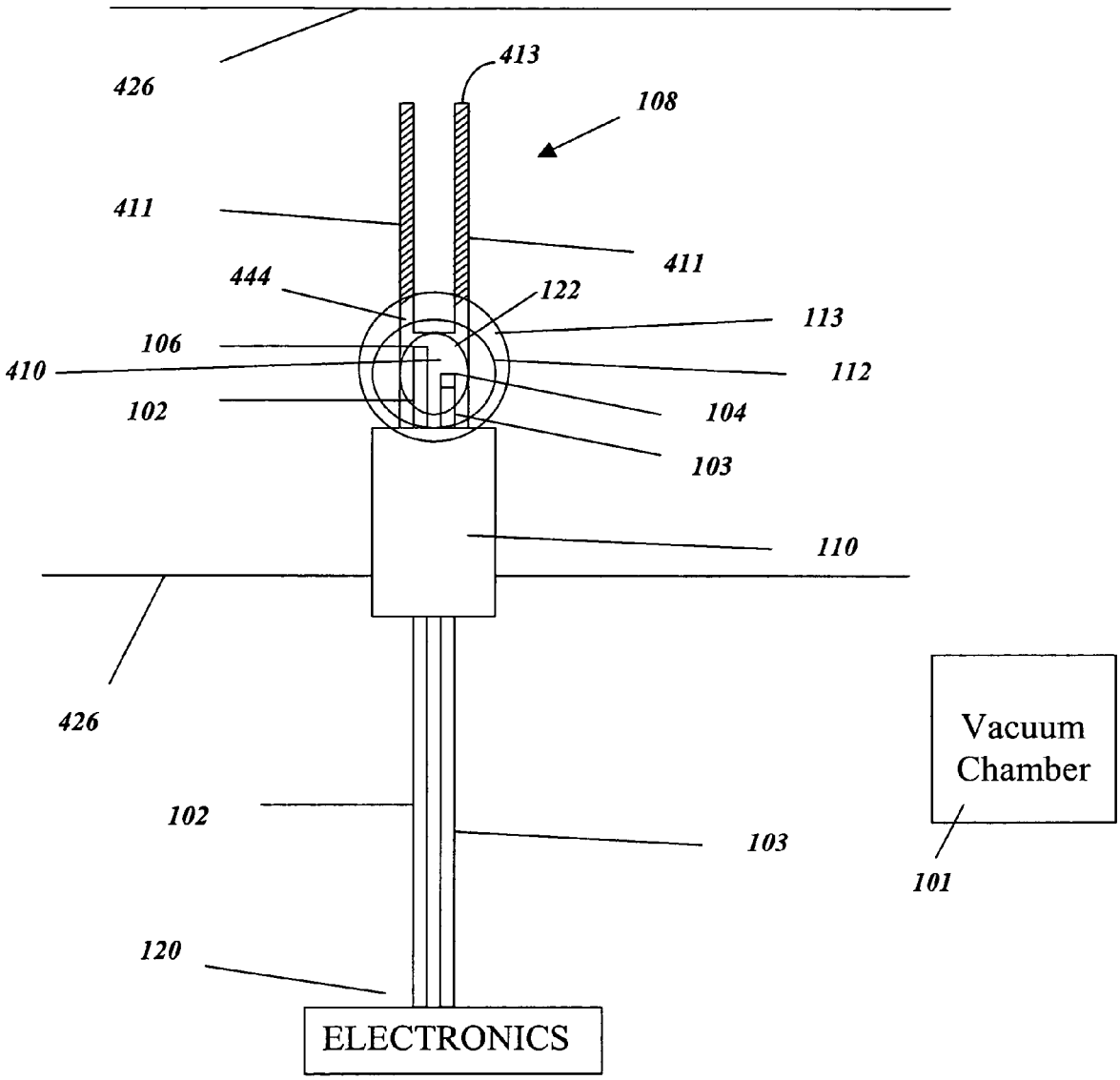
FIG. 1 is a depiction of an illustrative embodiment of a coated resonator.

In an illustrative embodiment, a downhole method and apparatus are disclosed using a coated mechanical resonator, for example, a tuning fork to provide real-time direct measurements and estimates of the viscosity, density and dielectric constant of formation fluid or filtrate in a hydrocarbon producing well. The resonator is coated with a high temperature coating to adhering of materials to the resonator and introducing errors into measurements based on the resonator response. An illustrative embodiment provides valuable information regarding properties of fluids downhole regarding hydrocarbon deposits downhole so that drilling and production decisions can made based on the properties of the fluids downhole. Millions of dollars must be invested in a drilling or production project. Thus, drillers are willing to pay significant sums of money for the information provided by an illustrative embodiment regarding properties of the fluids downhole from which to make drilling decisions.

Another particular illustrative embodiment additionally provides a method and apparatus for 1) monitoring cleanup from a leveling off of viscosity or density over time, 2) measuring or estimating bubble point for formation fluid or filtrate, 3) measuring or estimating dew point for formation fluid or filtrate, and 4) the onset of asphaltene precipitation. Another particular illustrative embodiment provides for intercalibration of a plurality of pressure gauges used to determine a pressure differential downhole. Each of these applications of an illustrative embodiment contributes to the commercial value of downhole monitoring while drilling and wire line tools. Thus, an illustrative embodiment provides direct viscosity and density measurement capability of a fluid downhole.

In one aspect of the invention, a downhole tool for determining the properties of a formation fluid sample is provided comprising a tool deployed in a well bore formed in an adjacent formation, the tool communicating and interacting with a quantity of downhole fluid, a mechanical resonator attached to the tool immersed in the fluid sample, a controller for actuating the mechanical resonator; and a monitor for receiving a response from the mechanical resonator to actuation of the mechanical resonator in the fluid. In another aspect of the invention a tool is provided further comprising a processor for determining a characteristic of a fluid sample from the response of the mechanical resonator. In another aspect of the invention a tool is provided wherein at least one of density, viscosity or dielectric constant are determined for a fluid downhole.

In another aspect of the invention a tool is provided wherein the characteristic of said fluid is used to determine the dew point of the fluid. In another illustrative embodiment a tool is provided wherein the characteristic of said fluid is used to determine the bubble point of a fluid. In another aspect of the invention a tool is provided where in the characteristic of the fluid is used to monitor the cleanup over time while pumping.

In another aspect of the invention a tool is provided to determine the dew point of a formation fluid downhole. In another illustrative embodiment a tool is provided wherein the characteristic of the fluid is used to determine the onset of asphaltene precipitation. In another illustrative embodiment a tool is provided wherein the characteristic of the fluid is used to estimate NMR decay times T1 and T2, which are inversely correlated to viscosity.

In another aspect of the invention a tool is provided further comprising a plurality of pressure gauges that are a known vertical separation distance apart in the fluid, wherein the mechanical resonator response is used to measure the density of the fluid to calculate the correct pressure difference for the amount of vertical separation. In another illustrative embodiment, the mechanical resonator is actuated electrically. The resonator is made of quartz and has metallic electrodes deposited on two or more of the resonator faces. The electrodes are epoxy coated to prevent corrosion of the contacts. In another illustrative embodiment, the mechanical resonator is placed in a cavity outside the direct flow path to protect the tuning fork from damage from debris passing in the sample flow path.

In another illustrative embodiment, a hard or inorganic coating is placed on the flexural mechanical resonator (such as a tuning fork) to reduce the effects of abrasion from sand particles suspended in the flowing fluid in which the flexural mechanical resonator is immersed.

Flexural mechanical resonators have been used in the laboratory for rapid characterization of large numbers of fluid samples. See L. F. Matsiev, Application of Flexural Mechanical Resonator to High Throughput Liquid Characterization, 2000 IEEE International Ultrasonics Symposium, Oct. 22-25, 2000 San Juan, Puerto Rico, incorporated herein by reference in its entirety; L. F. Matsiev, Application of Flexural Mechanical Resonator to High Throughput Liquid Characterization, 1999 IEEE International Ultrasonics Symposium, Oct. 17-20, Lake Tahoe, Nev., incorporated herein by reference in its entirety; L. F. Matsiev, Application of Flexural Mechanical Resonator to High Throughput Liquid Characterization, 1998 IEEE International Ultrasonics Symposium, Oct. 5-8, 1998, Sendai, Miyagi, Japan, incorporated herein by reference in its entirety.

In an illustrative embodiment, a coated tuning fork sensor (also referred to herein as resonator) for fluid density and viscosity is provided. Surfactants from oil based mud, such as amides and phosphates are substantially prevented from adhering to the surface of the coated fork. When such surfactants adhere or adsorb to an uncoated resonator they are typically not removed by rinsing with formation crude oil. The presence of these adsorbed surfactants can have an effect on the measured fluid density. Moreover, the adsorbed surfactants can increase the measured fluid viscosity quite substantially by a factor of two or more. In an illustrative embodiment, a coating, for example, AMC228-18, commercially available from AMCX Corporation is applied to the surface of the resonator.

When this AMC 228-18 or a similar coating is applied to a resonator surface, afterwards, surfactants that may have temporarily adhered to the coated resonator are rinsed off of the resonator with crude oil and subsequently enable the coated resonator to yield correct viscosity readings. This AMC228-18 coating is described by its manufacturer as being both hydrophobic and lipophobic. It is believed that the formulation of the coating is a "diamond-like" carbon (DLC) coating. Some popular, hard, non-polymeric, medical coatings include DLC, TiN, and various combinations of one of Ti, Ca, and Zr with one of C, N, O, and P. SiO2 coating can be water wet instead of being both hydrophobic and lipophobic like Teflon. Teflon can be problematic as it is soft and easily scratched or abraded. If the coating is abraded off of the resonator, this abrasion would change the fork tines' mass and its fluid density readings.

The AMC 228-18 is a lipophobic/hydrophobic coating and is a hard and scratch resistant coating having a low surface energy (non-stick properly) that is superior in scratch resistance to Teflon. Teflon is a soft coating so any passing sand could score the surface (changing the measured fluid viscosity) or abrade away some coating (changing the measured fluid density). Our preliminary analysis suggests that this medical lipophobic/hydrophobic coating is a diamond-like coating. Also, this medical lipophobic/hydrophobic coating can be autoclaved so it can survive high temperatures and pressures. Moreover, the medical lipophobic/hydrophobic coating is so thin and conformal that it can be used to coat the insides of hypodermic needles. An example of a suitable coating for use in an illustrative embodiment is a lower surface energy coating having a surface energy of less than about 20 dynes/$cm^2$.

The titanium nitride coating can be produced by evaporating high purity titanium using an electron beam and combining it with nitrogen in a vacuum chamber to produce a fine, molecular scale vapor. This is deposited on the full surface of the tuning fork or resonator to give an even, gold-colored, high integrity layer between one and three microns thick. DLC coating materials appear to have extreme hardness of 4,500 HV offers extended operational lives.

Another example of a suitable resonator coating is believed to be the Alpha™ coating made by AMCX Corporation. The Alpha™ coating is a premium all-purpose, composite coating that has ZrN as the top layer. The extreme hardness of this coating (4600 Hv), along with the lubricity provided by ZrN, enable this coating to outperform most others in a wide variety of applications, especially punching, forming and cutting tools. In most applications, Alpha™ will last two to four times longer than TiN due to its superior hardness, abrasion resistance and lubricity. Adding carbon to a TiN film increases the hardness nearly 80 percent. TiCN is also an excellent all-purpose coating.

After getting five times the tool life with the original coating, that coating can be stripped and the part recoated, resulting in five more times the tool life, on and on, and on. TiAlN has traditionally been a mono-layer, constant Ti/Al ratio, while AlTiN typically has varying amounts of aluminum in the firm. Some TiAlN is actually AlTiN because our coating has a gradually increasing percentage of aluminum in it as one goes through the coating, starting at the coating—substrate interface.

The design of the illustrative embodiment of the coating provides exceptional oxidation resistance and extreme hardness. DLC is a very promising coating material because it is chemically inert, extremely hard, and wear resistant. The high quality of ($sp^3$-fraction—80%) hydrogen-free DLC coatings tested were deposited (5 μm/h per 20 $cm^2$) with a filtered pulsed arc discharge method.

An illustrative embodiment applies a coating to flexural mechanical resonators such as tuning forks, benders, etc. to perform liquid characterization. Additional complex electrical impedance produced by a liquid environment to such resonators is also described. This additional impedance can be represented by the sum of two terms: one that is proportional to liquid density and a second one that is proportional to the square root the of viscosity density product. This impedance model is universally applicable to any resonator type that directly displaces liquid and has size much smaller than the acoustic wavelength in a liquid at its operation frequency. Using this model it is possible to separately extract liquid viscosity and density values from the flexural resonator frequency response, while conventional TSM resonators can measure only the viscosity density product.

FIG. 1 illustrates a coated covering 413 for a tuning fork tines 411 disposed in a fluid flow path 426. The coated covering 413 reduces effects of surfactants adhering to the tines 411. In an illustrative embodiment, the coating may be selected from a group consisting of but not limited to DLC coating, low surface energy coating, lipophobic coating, hydrophobic coating, AMC 228-18 coating and a material combinations of Ti, Co, and Zr combined with one of N, C, O and P. The coating may be any of the aforementioned coatings including but not limited to DLC, lipophobic, hydrophobic, AMCX and combinations of Ti, Co and Zr with one of N, C, O and P. As shown in FIG. 1, in one particular illustrative embodiment electrical leads 102 and 103 run through a high pressure feed through 110. The electrical leads 102 and 103 attach to turning fork electrical connections 104 and 106. Electrical connections 104 and 106 attach to electrodes inside of turning fork 108. Insulator 112 can be provided to cover the bare electrical leads 102 and 103 and electrical connections 104 and 106. Insulator 112 deforms rather than cracks under downhole pressure so that the insulator does not crack under pressure cycling and allow brine or formation fluids to penetrate the cracks or short out the electrical connections or leads under the insulator.

The insulator 112 covers the tuning fork electrical connections 104, 106 to the tuning fork electrodes to the extent necessary to prevent electrical shorting of the electrical connections 104, 106 from conductive fluid. The conductive fluid can be water, formation fluid or some other conductive fluid. The insulator is also chemically resistant so that the volume of the insulator does not change significantly when exposed to formation fluid. In another particular embodiment an adhesion promoter such as a CF6-35 primer 111 is placed on the tuning fork before applying insulator 112 to facilitate adhesion of the insulator to the tuning fork. A rigid epoxy 113 can be placed over the insulator 112 or under the insulator 112 to strengthen the insulator 112. As discussed above, the insulator is pliable so that the vibration of the tuning fork tines 411 is substantially unencumbered. A vacuum chamber 101 is provided to help deposit the coating 413 on the tines 411.

Thickness-shear mode (TSM) quartz resonators have been applied to the determination of mechanical properties of liquids for several decades. Oscillation of the TSM resonator surface exposed to liquid along a crystal-liquid interface produces a decaying viscous shear wave in liquid. A simple relationship between the impedance of the TSM resonator change caused by contact with a liquid and the viscosity density product of liquid has been derived using a simple one-dimensional mathematical model and is supported experimentally. It was found that the TSM resonator complex impedance in a liquid environment could be represented by an equivalent circuit 200 shown on FIG. 2.

Equivalent parameters $C_S$ 202, $R_o$ 204, $L_0$ 206 represent respectively mechanical compliance, loss and inertia of the resonator in vacuum. Additional impedance $Z(\omega)$ 208 produced by surrounding liquid is given by $(\omega\rho\eta)_{1/2}$ $(1+i)$ per unit interface area, where $\omega$ is the operation frequency, $\rho$ is the liquid density, $\eta$ is the viscosity of the liquid. Parallel capacitance $C_\rho$210, an electrical capacitance measured between the resonator electrodes, is also affected by electrical properties of surrounding liquid.

TSM quartz resonators have been successfully used for characterization of liquids. Unfortunately, quartz TSM resonators may suffer from several drawbacks: 1) It may be necessary to make additional experiments to measure liquid density and viscosity separately; and 2) viscosity and other properties of even low molecular weight liquids depend on frequency. The operation frequency of commercially available TSM resonators usually ranges from one to several tens of megahertz so TSM resonators measure the high-frequency response the fluid.

In practice, low-frequency response is usually more interesting. For example, most lubricants work under low-frequency shear stress. In the case of polymer solutions, TSM resonator response is virtually independent of polymer molecular weight and depends only on polymer concentration. All relaxation times from the polymer chain relaxation spectrum are usually much longer than the circle of viscous stress applied by TSM resonator, so the TSM resonator reacts as if it were in a solution of "solid" coils; almost all types of molecular motion seem frozen.

Figure 3:
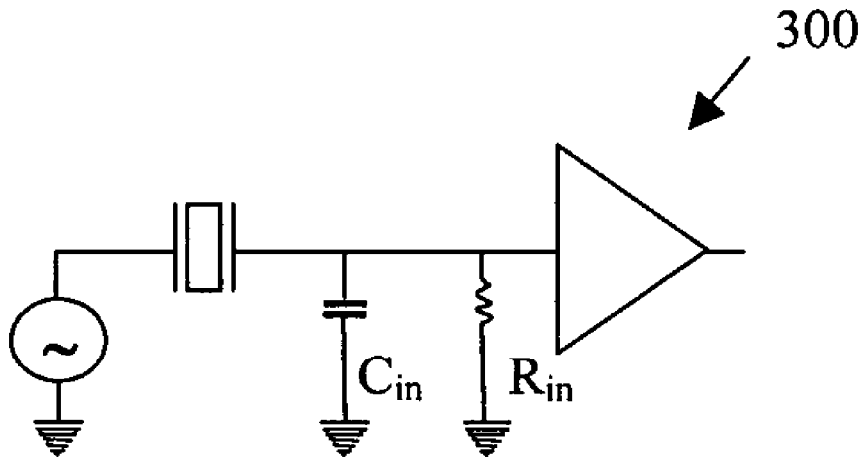
FIG. 3 is an illustration of resonator connections in an illustrative embodiment.

To avoid such problems low-frequency piezoelectric resonators such as bar benders, disk benders, cantilevers, tuning forks, micro-machined membrane and torsion resonators can be used. A wide variety of such resonators with operation frequency from hundreds of hertz up to few MHz are commercially available. There are a variety of ways to measure resonator response in a liquid environment. In a laboratory environment an HP8751A network analyzer can be used to sweep frequencies and measure response when the resonator was exposed to a variety of organic solvents. The equivalent impedance of tuning forks is quite high, so the use of high impedance probe is recommended. In another particular embodiment in a downhole environment, a swept analyzer circuit is provided to sweep and analyze or measure the resonator response. In an illustrative embodiment an exciter circuit 300 is used to excite the resonator and is connected as shown on FIG. 3.

The resonator impedance and probe amplifier known input impedance form a frequency dependent voltage divider. The frequency dependence of the normalized absolute value of the probe input voltage was recorded while resonator was submerged in various organic solvents. It is evident that the response of a tuning fork resonator is more strongly affected by the properties of the liquid than the response of a TSM resonator. Thus the tuning fork resonator thus provides much better resolution in the determination of liquid properties.

Figure 2:
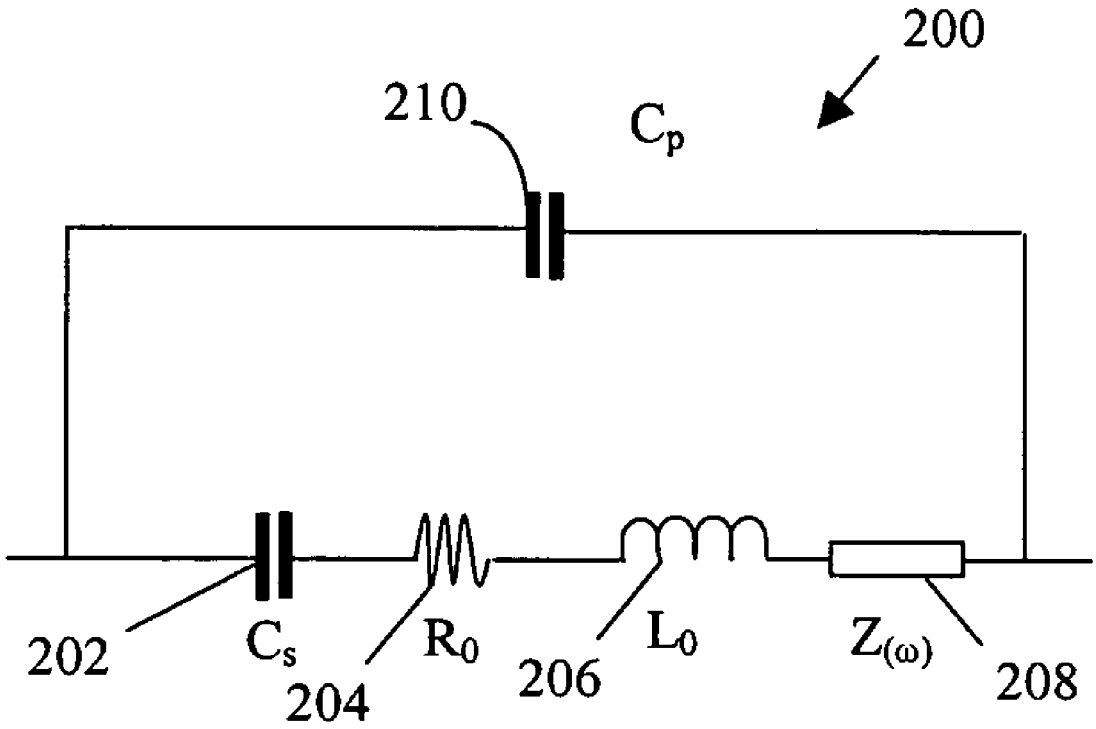
FIG. 2 is an illustration of a model for an equivalent circuit for a Thickness-shear mode (TSM) resonator complex impedance in a liquid environment.

The equivalent circuit 200 from FIG. 2 also describes the impedance of the flexural resonator with a modification for the additional impedance $Z(\omega)$ 208. Despite the complexity of such a 3D problem it is possible to state that the flow is in effect a viscous flow of an incompressible liquid. Oscillation velocity at the interfaces of an oscillating flexural resonator does have a component normal to the interface, so some compression should occur. In another particular embodiment, the size of flexural resonators is much less than a wavelength of the compression wave in surrounding liquid at operational frequency. Therefore low-frequency resonators are, in general, quite ineffective exciters of compression waves regardless of the oscillation mode.

For viscous incompressible flow the vorticity of the velocity field decays with the distance from the oscillating body in the same manner as the velocity decays with the distance from TSM resonator. This means that some component of the additional impedance of a flexural resonator should be proportional to $(\omega\rho\eta)^{1/2}(1+i)$ as is the case for the TSM resonator, with some unknown coefficient or geometry factor, which itself depends upon the resonator geometry and oscillation mode.

In contrast to TSM resonators flexural resonators directly displace liquid. The virtual hydrodynamic mass attached to a body moving in a liquid due to direct displacement depends only on the body geometry and liquid density. It should manifest itself as an additional inductive component of the equivalent impedance proportional to liquid density.

That additional impedance of a flexural resonator is represented by the following relationship: $Z(\omega)=Ai\omega\rho+B\sqrt{\omega\rho\eta}(1+i)$, where $\omega$ is the operation frequency, $\rho$ is the liquid density, $\eta$ is the liquid viscosity, A and B are the geometry factors that depend only on the resonator geometry and mode of oscillation. Alternatively, this relationship can be rewritten as: $Z(\omega)=i\omega\Delta L+\Delta Z\sqrt{\omega}(1+i)$, where $\Delta L=\rho$ and $\Delta AZ=B\sqrt{\rho\eta}$ are frequency independent parameters, which can be easily calculated by fitting experimental data using, for example, the least squares method.

In practice, the low-frequency response of the resonator is usually more interesting. For example, most lubricants work under low-frequency shear stress. In the case of polymer solutions, TSM resonator response is virtually independent of polymer molecular weight and depends only on polymer concentration. All relaxation times from the polymer chain relaxation spectrum are usually much longer than the circle of viscous stress applied by TSM resonator, so the TSM resonator reacts as if it were in a solution of "solid" coils; almost all types of molecular motion seem frozen.

To avoid such problems low-frequency piezoelectric resonators such as bar benders, disk benders, cantilevers, tuning forks, micro-machined membrane and torsion resonators can be used. A wide variety of such resonators with operation frequency from hundreds of hertz up to few MHz are commercially available.

TSM resonators do not move fluid substantially and thus do not separately yield density and viscosity of a fluid. Flexural mechanical resonators respond to the both the density and viscosity of a fluid into which they are immersed. A miniature tuning fork resonator, is provided in an illustrative embodiment which enables separate determination of density and viscosity of fluid, rather than merely the product of these two properties. TSM resonators can only determine the product of density and viscosity and thus viscosity or density could not be independently determined. An illustrative embodiment provides a tuning fork or flexural resonator, which is excited, monitored and process to separately determine not only the density and viscosity of a fluid, but also the dielectric constant of a fluid. The resonator tuning forks are very small, approximately 2 mm.times.5 mm, are inexpensive and have no macroscopically moving parts. The resonator tuning forks can operate at elevated temperature and pressure and enable a more accurate method of determining viscosity and other fluid properties downhole than other known methods. The tuning forks are commercially available from Symyx and are made of quartz with silver or gold electrodes. The typical accuracy for determination using the tuning forks is ±0.01% for density, ±1.0% for viscosity, and ±0.02% for dielectric constant. In an embodiment, the electrodes are connected to wires. The connections between the wires and electrodes are covered with epoxy to prevent corrosion of the connections to the electrodes.

The most common method for determining downhole fluid density is determination of the pressure gradient. Density is proportional to the slope of a plot of pressure versus depth over a depth interval of 50-150 feet. Generally, the tool is moved from point to point in the well so that the same pressure gauge is used to make all the pressure readings. It is hard to keep two different pressure gauges inter-calibrated within a few tenths of a PSI at high temperatures and pressures.

The measurement of viscosity downhole can be estimated from the well-known inverse relationship between Nuclear Magnetic Resonance (NMR) decay time and viscosity. Alternatively, any differential pressure gauge sensitive enough to determine density from a short-spacing (10-20 feet) pressure gradient should be sufficiently sensitive to determine viscosity from the pressure drop versus flow rate in a wire line formation tester. The present invention enables making an accurate differential pressure gauge based on the present invention enabling performing inter-calibration between two pressure gauges.

The flexural mechanical oscillator generates a signal which is utilized to determine formation fluid properties and transmits the signal to a processor or intelligent completion system (ICE) 30 for receiving, storing and processing the signal or combination of signals.

Figure 4:
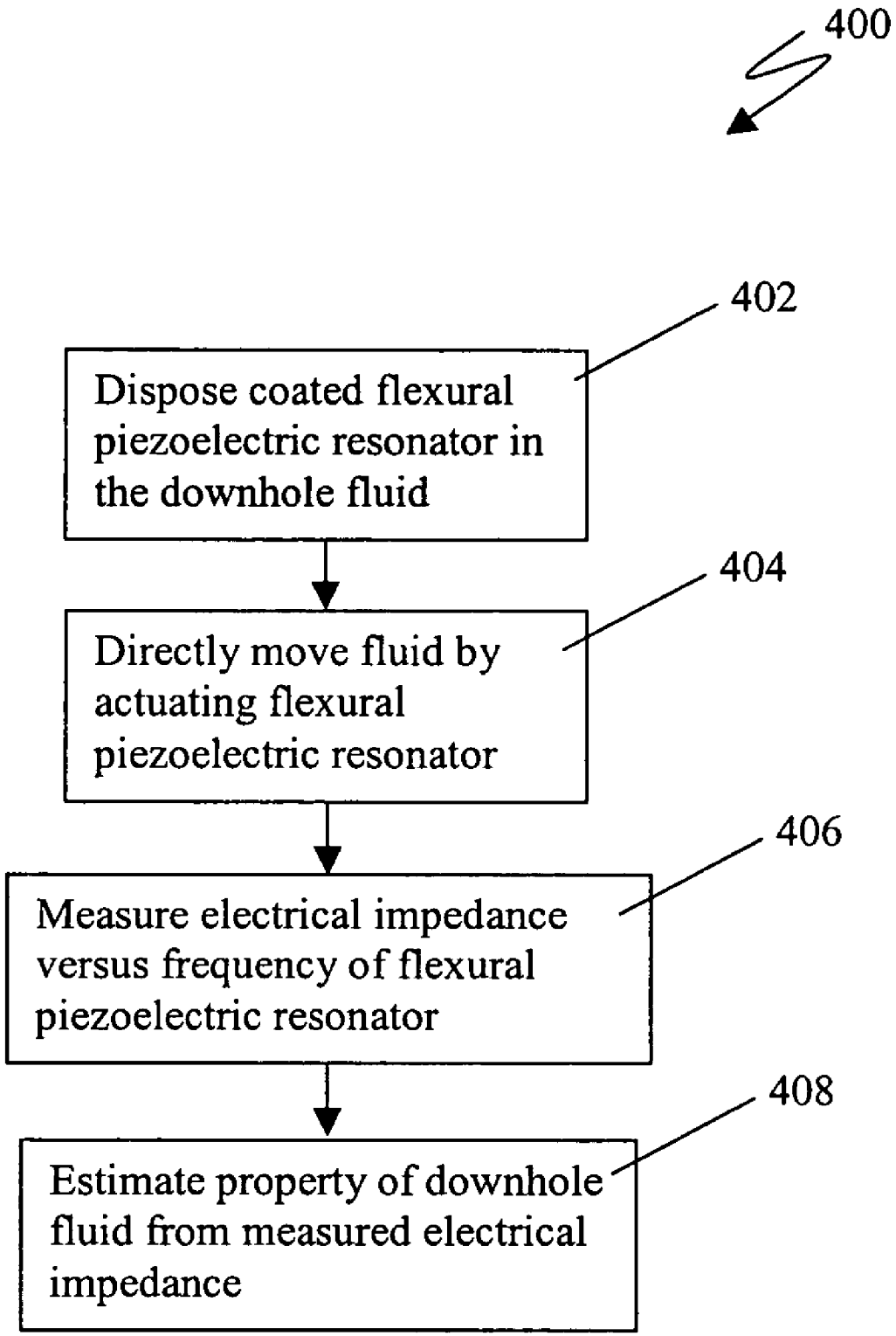
FIG. 4 is a flowchart depicting a method for estimating a property of a downhole fluid.

FIG. 4 is a flow chart depicting a method for estimating a property of a downhole fluid. The coated flexural piezoelectric resonator is disposed in the downhole fluid at block 402. The fluid is directly moved by the actuating flexural piezoelectric resonator at block 404. Electrical impedance versus frequency of flexural piezoelectric resonator is measured at block 406. The property of the downhole fluid from measured electrical impedance is estimated at block 408.

Figure 5:
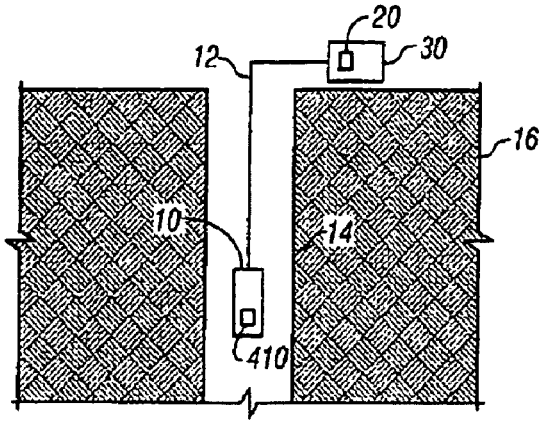
FIG. 5 is a schematic diagram of an embodiment of the present invention deployed on a wire line in a downhole environment.
Figure 6:
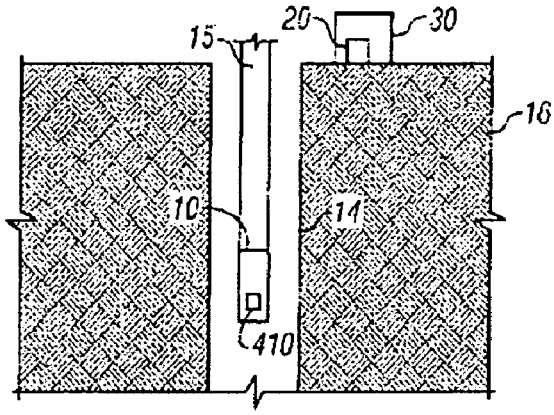
FIG. 6 is a schematic diagram of an embodiment of the present invention deployed on a drill string in a monitoring while drilling environment.
Figure 7:
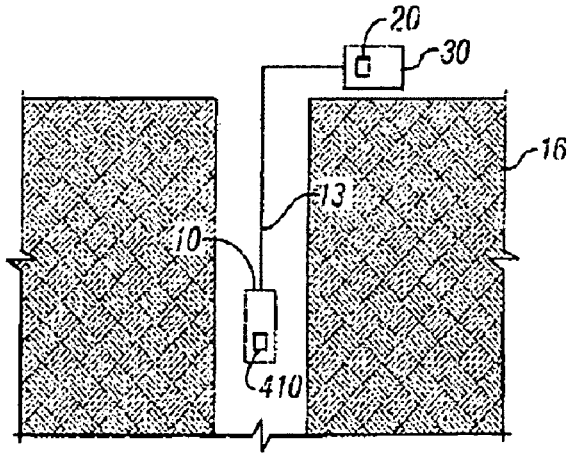
FIG. 7 is a schematic diagram of an embodiment of the present invention deployed on a flexible tubing in a downhole environment.

FIG. 5 is a schematic diagram of an illustrative embodiment deployed on a wire line in a downhole environment. As shown in FIG. 5, a downhole tool 10 containing a mechanical resonator 410 is deployed in a borehole 14. The borehole is formed in formation 16. Tool 10 is deployed via a wireline 12. Data from the tool 10 is communicated to the surface to a computer processor 20 with memory inside of an intelligent completion system 30. FIG. 6 is a schematic diagram of an illustrative embodiment deployed on a drill string 15 in a monitoring while drilling environment. FIG. 7 is a schematic diagram of an illustrative embodiment deployed on a flexible tubing 13 in a downhole environment.

Figure 8:
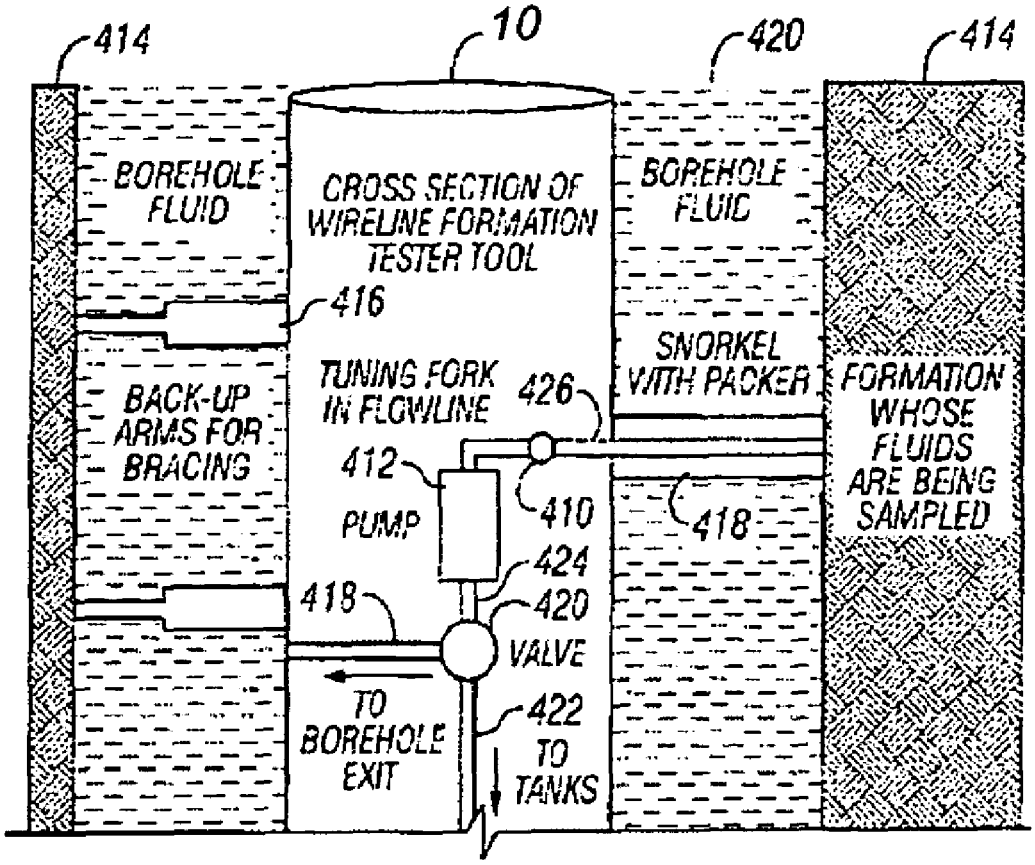
FIG. 8 is a schematic diagram of an embodiment of the present invention as deployed in a wireline downhole environment showing a cross section of a wireline formation tester tool.

FIG. 8 is a schematic diagram of an illustrative embodiment as deployed in a wireline downhole environment showing a cross section of a wireline formation tester tool. As shown in FIG. 8, tool 416 is deployed in a borehole 420 filled with borehole fluid. The tool 416 is positioned in the borehole by backup support arms 416. A packer with a snorkel 418 contacts the borehole wall for extracting formation fluid from the formation 414. Tool 416 contains coated tuning fork 410 disposed in flow line 426. Any type of flexural mechanical oscillator is suitable for deployment in the tool of the present invention. The mechanical oscillator, shown in FIG. 8 as the coated tuning fork is excited by an electric current applied to its electrodes and monitored to determine density, viscosity and dielectric coefficient of the formation fluid. The electronics for exciting and monitoring the flexural mechanical resonator as shown in the Matsiev references are housed in the tool 10. Pump 412 pumps formation fluid from formation 414 into flow line is 426. Formation fluid travels through flow line 424 in into valve 420 which directs the formation fluid to line 422 to save the fluid in sample tanks or to line 418 where the formation fluid exits to the borehole. The tuning fork is excited and its response in the presence of a formation fluid sample is utilized to determine fluid density, viscosity and dielectric coefficient while fluid is pumped by pump 412 or while the fluid is static, that is, when pump 412 is stopped.

Figure 9:
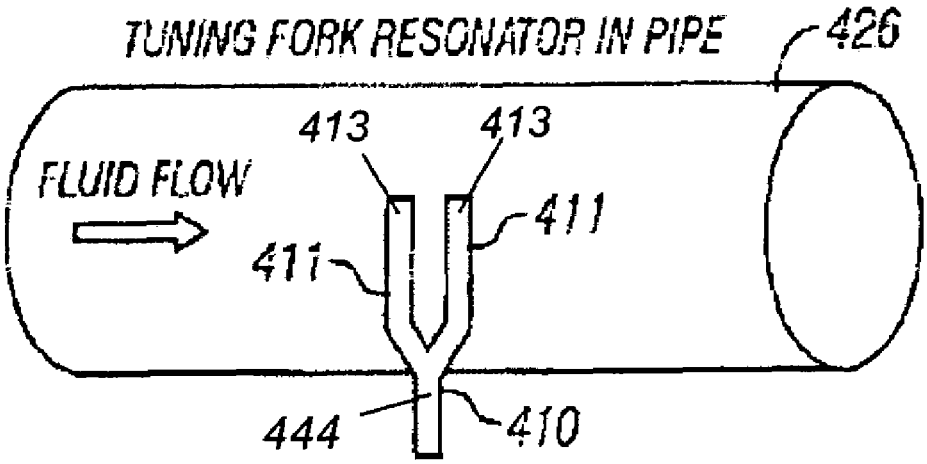
FIG. 9 is a schematic diagram of an embodiment of the present invention illustrating a tuning fork as deployed in a fluid flow pipe.

FIG. 9 is a schematic diagram of an embodiment of the present invention illustrating a tuning fork 412 with tines 411 and coating 413 deployed in a fluid flow pipe 426. A hard coating 444 can be added to turning fork 410 or other mechanical resonator to reduce the effects of abrasion. A coating 444 can also be applied to control the electrical conductivity at the surface of the resonator 410.

In a second scenario of operation the fluid sample flowing in the tool is stopped from flowing by stopping the pump 412 while the mechanical resonator is immersed in the fluid and used to determine the density, viscosity and dielectric constant for the static fluid trapped in the tool.

Samples are taken from the formation by pumping fluid from the formation into a sample cell. Filtrate from the borehole normally invades the formation and consequently is typically present in formation fluid when a sample is drawn from the formation. As formation fluid is pumped from the formation the amount of filtrate in the fluid pumped from the formation diminishes over time until the sample reaches its lowest level of contamination. This process of pumping to remove sample contamination is referred to as sample clean up. In a particular illustrative embodiment, the present invention indicates that a formation fluid sample clean up is complete when the viscosity or density has leveled off or become asymptotic within the resolution of the measurement of the tool for a period of twenty minutes to one hour. A density or viscosity measurement is also compared to a historical measure of viscosity or density for a particular formation and or depth in determining when a sample is cleaned up. That is, when a sample reaches a particular level or value for density and or viscosity in accordance with a historical value for viscosity and or density for the formation and depth the sample is determined to have been cleaned up to have reached a desired level of purity.

The bubble point pressure for a sample is indicated by that pressure at which the measured viscosity for formation fluid sample decreases abruptly. The dew point is indicated by an abrupt increase in viscosity of a formation fluid sample in a gaseous state. The asphaltene precipitation pressure is that pressure at which the viscosity decreases abruptly.

The present invention also enables calibration of a plurality of pressure gauges at depth. Pressure gauges are typically very sensitive to changes but not accurate as to absolute pressure. That is, a pressure gauge can accurately determine a change of 0.1 PSI but not capable of accurately determining whether the pressure changed from 1000.0 to 1000.1 PSI or 1002.0 to 1002.1 PSI. That is, the precision is better than the accuracy in the pressure gauges. A particular illustrative embodiment enables determination of the absolute pressure difference between pressure gauges in a downhole tool and enables determination of the density of the fluid. Since the distance between the downhole pressure gauges is known, one can determine what the pressure difference or offset should be between the pressure gauges at a particular pressure and temperature. This calibration value or offset is added to or subtracted from the two pressure gauge readings. The calibration value is calculated in a nonconductive fluid, such as oil and can be applied when measuring pressure differential in conductive fluid, such as water where the tuning fork will not measure density or in the non-conductive fluid.

In an illustrative embodiment, the dielectric constant is calculated for a formation fluid sample as discussed in the Matsiev references. An illustrative embodiment can utilize the Matsiev calculations to calculate density and viscosity. A particular illustrative embodiment provides a chemo metric equation derived from a training set of known properties to estimate formation fluid parameters. The present invention provides a neural network derived from a training set of known properties to estimate formation fluid parameters. For example, from a measured viscosity, a chemo metric equation can be used to estimate NMR properties $T_1$ and $T_2$ for a sample to improve an NMR measurement made independently in the tool. The chemo metric equation can be derived from a training set of samples for which the viscosity and NMR $T_1$ and $T_2$ are known. Any soft modeling technique may be applicable with an illustrative embodiment.

Another particular illustrative embodiment can be utilized to provide density, viscosity, dielectric coefficient and other measured or derived information available from the tool of the present invention to a processor or intelligent completion system (ICS) at the surface. The ICS is a system for the remote, intervention less actuation of downhole completion equipment has been developed to support the ongoing need for operators to lower costs and increase or preserve the value of the reservoir, which are particularly important in offshore environments where well intervention costs are significantly higher than those performed onshore.

An operator, located at the surface and having access to over ride the processor/ICE 30 may make his own decisions and issue commands concerning well completion based on the measurements provided by the present invention. A particular illustrative embodiment may also provide data during production logging to determine the nature of fluid coming through a perforation in the well bore, for example, the water and oil ratio.

As shown in FIG. 1, the coating 413 may coat only the tines 411 or may coat the entire tuning fork 410 and the tines 411. In another illustrative embodiment of the invention, a hard or inorganic coating 444 can be placed on the flexural mechanical resonator 410 (such as a tuning fork) and tines 411 to reduce the effects of abrasion from sand particles suspended in the flowing fluid in which the flexural mechanical resonator is immersed. The coating should be hard enough to protect against sand abrasion. For example, the coating should be harder than glass (sand). A coating 444 can also be applied to control the electrical conductivity at the surface of the resonator 410. When used in conductive fluids, a nonconductive coating can be applied to a resonator that has exposed electrodes to prevent electrically shorting these electrodes. Alternatively, for a resonator whose electrodes are not exposed at the surface, a conductive coating can be applied to provide electrical shielding.

Some appropriate coatings are Silicon Nitride (SiN), Titanium Nitride (TiN), EverShield water-borne ceramic coating from Blue Sky Aviation this is useable up to 2000 F, Praxair Coatings, (see, e.g., http:/www.praxair.com/praxair.nsf/7al106cc7ce1c54e85256a9c005accd7/82969d7f3fbe9b7d85256f40005ca445?OpenDocument); Silicon Oxide (SiO2), VitriSeal inorganic silicate; Silanizing (treating a surface with silanes, which are any silicon hydrides, which are analogous to the paraffin hydrocarbons); and Parylene.

The foregoing example is for purposes of example only and is not intended to limit the scope of the invention which is defined by the following claims.

What is claimed is:

1. An apparatus for estimating a property of a fluid downhole comprising:

a coated flexural resonator having bare electrical leads, wherein the resonator is coated to reduce effects of surfactants adhering to the flexural resonator;

a pliable insulator covering the bare electrical leads, wherein the pliable insulator deforms rather than cracks under pressure downhole; and a controller that actuates the flexural resonator at a frequency.

2. The apparatus of claim 1, wherein the insulator is chemical resistant so that a volume of the insulator does not substantially change when exposed to formation fluid downhole.

3. The apparatus of claim 1, wherein the flexural resonator is coated with a low surface energy coating having a surface energy of less than 20 dynes/cm$^2$.

4. The apparatus of claim 1, wherein the pliable insulator enables the resonator to vibrate unencumbered.

5. The apparatus of claim 1, further comprising:

a strength member covering a surface of the insulator.

6. The resonator of claim 1, wherein the resonator is coated with AMC 228-18.

7. The resonator of claim 1, wherein the resonator is coated with a material selected from the group consisting of a diamond-like carbon coating and combinations of Ti, Co and Zr with one of N, C, O and P.

8. A method for estimating a property of a fluid downhole comprising:

disposing a coated flexural piezoelectric resonator having bare electrical leads covered with a pliable insulator and a pliable insulator covering the bare electrical leads, wherein the pliable insulator deforms rather than cracks under pressure in the downhole fluid;

directly moving the fluid by actuating the flexural piezoelectric resonator;

measuring an electrical impedance versus frequency of the flexural piezoelectric resonator; and estimating the property of the downhole fluid from the measured electrical impedance.

9. The method of claim 8, wherein the wherein pliable insulator is chemical resistant so that a volume of the insulator does not substantially change when exposed to formation fluid downhole.

10. The method of claim 8, wherein pliable insulator enables the resonator to vibrate unencumbered.

11. The method of claim 8, wherein the insulator further comprises a strength member covering a surface of the insulator.

12. The method of claim 8, wherein the resonator is coated with AMC 228-19.

13. The method of claim 8, wherein the resonator is coated with a low surface energy coating having a surface energy of less than 20 dynes/cm$^2$.

14. The method of claim 8, wherein the resonator is coated with a material selected from the group consisting of a diamond-like carbon coating and combinations of Ti, Co and Zr with one of N, C, O and P.

15. A downhole tool for estimating a property of a fluid downhole comprising:

a coated flexural piezoelectric resonator having bare electrical leads covered by a pliable insulator, wherein the pliable insulator deforms rather than cracks under downhole pressure, wherein the resonator is associated with the downhole tool and disposed in the downhole fluid, wherein the resonator is coated to reduce effects of surfactants adhering to the resonator; and a controller that actuates the flexural piezoelectric resonator at a frequency.

16. The downhole tool of claim 15, wherein the resonator is coated with a material selected from the group consisting of a diamond-like carbon coating and combinations of Ti, Co and Zr with one of N, C, O and P.

17. The downhole tool of claim 15, wherein the pliable insulator is chemical resistant so that a volume of the insulator does not substantially change when exposed to downhole fluid.

18. The downhole tool of claim 15, wherein the resonator is coated with a low surface energy coating having a surface energy of less than 20 dynes/cm$^2$.

19. The downhole tool of claim 15, wherein the pliable insulator enables the resonator to vibrate unencumbered.

20. The downhole tool of claim 15, further comprising:

a strength member covering a surface of the insulator.

* * * * *